United States Patent [19]

Battista

[11] 4,271,492

[45] Jun. 2, 1981

[54] SOUND ACTUATED CLOCK-MIRROR

[76] Inventor: Anthony M. Battista, 2126 Pierce St., Hollywood, Fla. 33020

[21] Appl. No.: 112,728

[22] Filed: Jan. 17, 1980

[51] Int. Cl.[3] ..... G04B 47/00; G04B 19/30

[52] U.S. Cl. ..... 368/10; 368/67; 368/227

[58] Field of Search ..... 368/10, 62, 67, 88, 368/223, 227, 232, 234, 276, 278, 285; 340/148

[56] References Cited

U.S. PATENT DOCUMENTS 2,132,474 10/1938 Holm ..... 368/10 X

FOREIGN PATENT DOCUMENTS 2643912 3/1978 Fed. Rep. of Germany ..... 340/148

*Primary Examiner*—Vit W. Miska

*Attorney, Agent, or Firm*—Ernest H. Schmidt

[57] ABSTRACT

A half-silvered mirror closes off one end of a peripheral housing, in spaced relation behind which half-silvered mirror is a clock face. Lighting means within the space between the half-silvered mirror and the clock face provides for selective illumination of the clock face for visualization through the half-silvered mirror. Sound actuated means is also provided for selective temporary energization of the lighting means to illuminate the clock face for time telling.

10 Claims, 5 Drawing Figures

SOUND ACTUATED CLOCK-MIRROR

BACKGROUND OF THE INVENTION

This invention relates to mirror and time clocks of the type used as decorative room furnishing accessories.

The use of hanging clocks and mirrors as decorative accessories is commonplace. Also known are decorative mirrors having half-silvered mirror faces which can be selectively illuminated from behind for visualizing for observation through the front of the mirror of decorative lighting effects, infinitely reflecting lighting effects, and the like, all of which are enclosed behind the mirror face. The electrical illumination within the mirror assemblage of such prior devices is either continuously off or continuously on, depending upon whether it is desired to be used as a mirror or as a decorative lighting accessory.

SUMMARY OF THE INVENTION

This invention is directed to a novel and improved decorative room furnishing accessory normally having the appearance of a decorative wall mirror, but presenting, upon actuation thereof by the creation of a predetermined sound, a decorative clock face for time reading through the face of the mirror, selectively as desired. The sound actuated clock-mirror is remotely controllable, such as by snapping one's fingers or clapping one's hands, to temporarily illuminate the interiorly contained clock face for visualization through the face of the mirror whenever it is desired to know the time of day.

The invention thus has for its principal object the provision of a decorative sound actuated clock-mirror which normally serves as a decorative mirror but which, when desired, can be remotely controlled for time telling as a decorative clock, with the clock face being visible through the front of the mirror only for a short, pre-determined interval sufficient for reading the clock.

A more particular object of the invention is to provide a decorative clock-mirror of the character described wherein the clock lighting means, upon its energization, is seen to comprise a plurality of miniature electrical lamps peripherally arranged about the clock face.

Still another object of the invention is to provide a sound actuated clock-mirror of the character described which will be simple in construction, inexpensive to manufacture, attractive in appearance, durable in use and dependable in operation.

Other objects, features and advantages of the invention will be apparent from the following description when read with reference to the accompanying drawings.

BRIEF DESCRIPTION OF THE DRAWINGS

In the drawings, wherein like reference numerals denote corresponding parts throughout the several views.

DESCRIPTION OF THE PREFERRED EMBODIMENT

Figure 4:
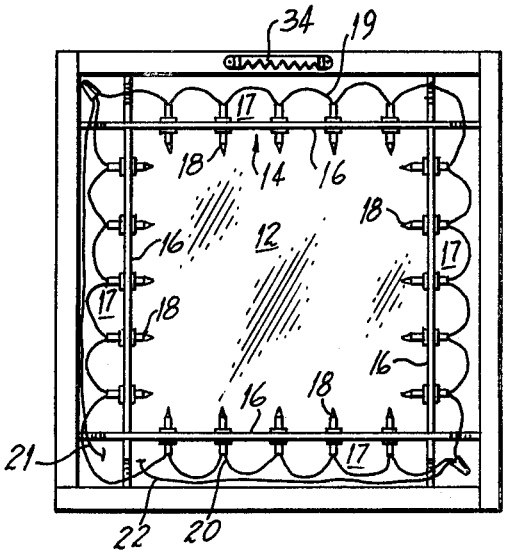
FIG. 4 is a rear view similar to that of FIG. 3 but with the clock mechanism and its support structure removed to reveal the internal lighting system.
Figure 5:
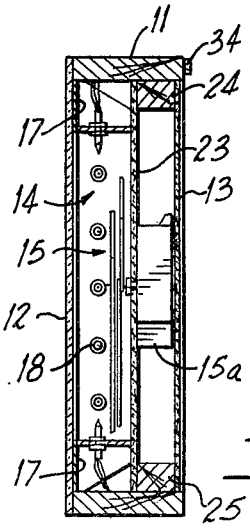
FIG. 5 is a vertical cross-sectional view taken along the line 5—5 of FIG. 2 in the direction of the arrows.

Referring now in detail to the drawings, reference numeral 10 in FIG. 1, designates, generally, a preferred form of sound actuated clock-mirror embodying the invention, the same comprising a rectangular housing 11 at the front of which a half-silvered plate glass mirror 12 is affixed, and at the rear of which is a back panel enclosure 13 of plywood, fiberboard or the like, as is hereinafter more particularly described. As best illustrated in FIGS. 4 and 5, there is fitted against the inside of the half-silvered mirror 12, an assembly of miniature lamps 14 which, as is hereinafter more particularly described, are sound actuated for illuminating a clockwork 15*a* supported behind said lights or lamps assembly. As illustrated in FIG. 4, the miniature lights or lamps assembly 14 comprises four elongated strips of fiberboard or other electrically insulating material 16, which may conveniently be inter-assembled by use of interfitting transverse slots extending halfway therethrough and equidistantly spaced from the ends thereof to define a central opening, the faces of which are in spaced relation with respect to the inside faces of the rectangular housing 11. As is best illustrated in FIG. 5, a peripheral paper or paper-like mask 17 is placed against the inside of the marginal portion of the half-silvered mirror 12 at the outside of the strips of fiberboard 16 comprising the miniature lights or lamps assembly 14. As further illustrated in FIG. 4, the strips of fiberboard 16 are provided with a plurality of equidistantly spaced openings, extending through which are a plurality of miniature electric lamps 18 serving to illuminate the inside of the space between the half-silvered mirror 12 and the face 15 of the clockwork 15*a*, as is hereinafter more particularly described. The miniature electric lamps 18 will preferably be connected in series for standard 115 volt AC household current supply operation, and may comprise two strings 19, 20 of ten lamps each connected in parallel with energizing conductors 21, 22.

Figure 3:
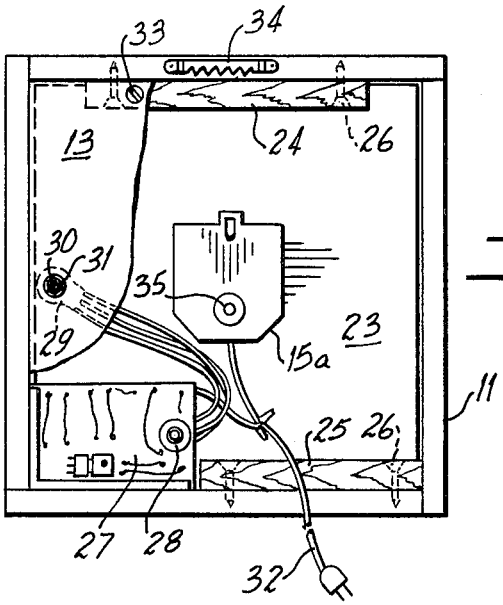
FIG. 3 is a rear view of the mirror-clock with a portion of the back cover broken away to reveal interior constructional details.

As illustrated in FIGS. 3 and 5, the clockwork 15 is centrally secured to a suitable support panel 23, which may also be of fiberboard, said support panel being of slightly smaller size than the inner dimensions of the rectangular housing 11 so as to abut flat against the outer edges of the fiberboard strips of the miniature lights or lamps assembly 14, in spaced parallel relation with respect to the half-silvered mirror 12. As best illustrated in FIGS. 3 and 5, the support panel 23 is removably retained in place, such as by the use of rectangular wood strips 24,25 clamped thereagainst at the outside, and secured with respect to inside portions of the upper and lower sidewalls of the rectangular housing 11 as by wood screws 26.

Means is provided for energizing the lamps 18 of the miniature lights or lamps assembly 14 upon the making of a pre-determined sound, such as the sound made upon clapping one's hands or snapping one's fingers within a distance of ten to twenty feet of the clock-mirror. To this end, the energization conductors 21, 22 of the electrical lamps 18 are connected in series with a solid state, sound-actuated switching circuit on printed circuit board 27 fitted against the outside of clock support panel 23. Mounted on the circuit board is an audio transducer 28 serving to pick up the sound for control input to the switching circuitry. The circuitry also includes a sensitivity adjustment potentiometer 29 supported against the outside of the clockwork support panel 23 and having a screw-driver adjustment shaft 30 in register with an access opening 31 in the back panel 13. An electrical plug-in connector cord 32 serves to energize the electric clock 15*a*, as well as the series-connected miniature lights or lamps assembly 14 and sound-actuated circuit board 27. Since sound-actuated electrical switching devices and circuitry are known, no claims are made with respect thereto apart from combination therewith of the internally lighted clock-mirror herein disclosed. It will be understood that the switching or control circuitry could be of various known designs with electronic filtering for selective operation with pre-determined sensitivity to clapping of the hands, snapping of the fingers, whistling or other sounds, as may be desired. It is also contemplated, as a preferred embodiment of the invention, that electronic timing means be provided in the switching control circuitry to automatically open-circuit and switch the miniature lamps off at a pre-determined period after their energization, say five or ten seconds thereafter.

As illustrated in FIGS. 3 and 5, the back closure panel 13 is of such size as to fit snugly within the sidewalls of the rectangular housing 13 against the wood clamp strips 24, 25, to which it is secured by a plurality of wood screws 33. An adjustable hook fitting 34 is affixed centrally along the back edge of the upper side of the housing 11 for convenience in hanging the sound actuated clock-mirror against a wall.

Figure 1:
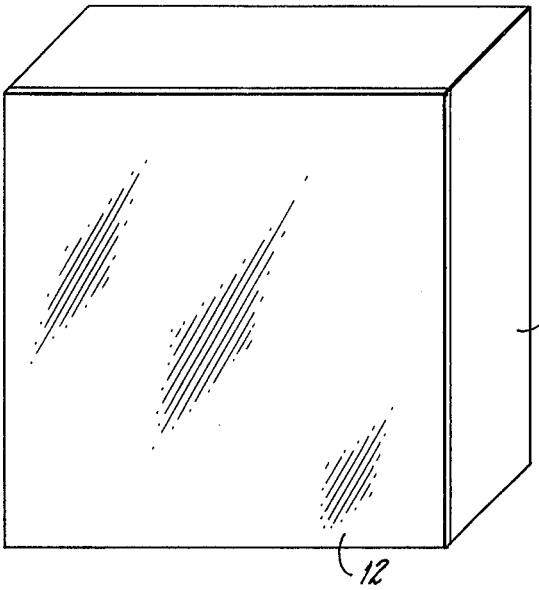
FIG. 1 is an oblique view, as seen from the front, of a sound actuated clock-mirror embodying the invention.
Figure 2:
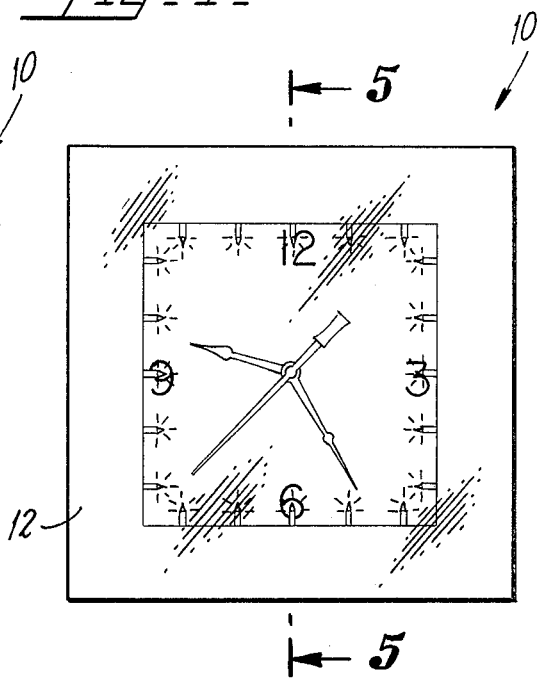
FIG. 2 is a front elevational view of the clock-mirror, shown in actuated condition to display the normally concealed clock.

In use, because there is normally no back lighting within the housing 11, the half-silvered mirror 12 will have the appearance of an ordinary mirror, as illustrated in FIG. 1, and will normally be used as such, whether simply as a decorative mirror, or a practical mirror used in applying make-up, for example. To observe the face 15 of the time clock 15*a*, it is only necessary to produce the pre-determined sound, such as by snapping the fingers, whereupon the miniature electric lamps 18 will become energized to illuminate the space behind the half-silvered mirror and thereby make the clock face visible, as illustrated in FIG. 2. The peripherally arranged multiple lamp illumination provides a novel and decorative lighting effect, enhancing the beauty of the clock-mirror as a decorative accessory to home furnishing. As hereinabove described, the illumination of the clock is automatically discontinued after a pre-determined time interval sufficient to enable reading of the clock, whereafter the clock-mirror returns to its usual state as a decorative wall mirror. An access opening in the back panel 13 (not illustrated) allows manual reaching through to the usual pull and turn time-setting spindle or knob 34.

While I have illustrated and described herein only one form in which my invention can conveniently be embodied in practice, it is to be understood that this form is presented by way of example only and not in a limiting sense. My invention, in brief, comprises all the embodiments and modifications coming within the scope and spirit of the following claims.

What is claimed is:

1. A sound actuated clock-mirror comprising, in combination, peripheral housing having front and back ends, a partially silvered flat mirror secured to and enclosing the front end of said housing, a flat clockwork support panel fixed within said peripheral housing in spaced relation with respect to said half-silvered mirror, a clockwork supported by said support panel and having its hands located within the space between said clockwork panel and said half-silvered mirror for reading against the inner surface of said support panel and for selective observation through said mirror, electrical lighting means within the space between said half-silvered mirror and said clockwork support panel, and an energization circuit for said electrical lighting means, said energization circuit comprising a sound-actuated electronic switch for selectivly energizing said lighting means upon the creation of a pre-determined sound.

2. A sound actuated clock-mirror as defined in claim 1 wherein the inside of said clockwork support panel comprises a clock face, and wherein said electrical lighting means comprises a plurality of electrical lamps peripherally arranged with respect to said clock face and in spaced relation with respect to the inner periphery of said housing.

3. A sound actuated clock-mirror as defined in claim 2 including support means for said plurality of electrical lamps, said lamps support means comprising opaque divider strip means extending between the insides of said half-silvered mirror and said clockwork support panel, said divider strip means being operative to prevent light from said electrical lamps radiating into the peripheral marginal zone between the inner periphery of said housing and the outer periphery of said divider strip means.

4. A sound actuated clock-mirror as defined in claim 3 and further including an opaque mask fitted against the inside of said half-silvered mirror at the peripheral zone between the inside of said peripheral housing and the peripheral outside of said divider strip means.

5. A sound actuated clock-mirror as defined in claim 2 wherein said peripheral housing is rectangular in shape.

6. A sound actuated clock-mirror as defined in claim 5 wherein said electrical lamps are arranged in spaced relation along lines defining a rectangle within the rectangle defined by the inner walls of said rectangular housing.

7. A sound actuated clock-mirror as defined in claim 6 including support means for said plurality of electrical lamps, said lamp support means comprising four opaque divider strips extending between the insides of said half-silvered mirror and said clockwork support panel, said divider strips being operative to prevent light from said electrical lamps radiating into the peripheral marginal zone between the inner periphery of said housing and the outer periphery of said divider strips.

8. A sound actuated clock-mirror as defined in claim 7 and further including an opaque mask fitted against said half-silvered mirror at the peripheral zone between the inside of said peripheral housing and the peripheral outside of said divider strips.

9. A sound actuated clock-mirror as defined in claim 8 including a closure panel fitted against the back end of said housing.

10. A sound actuated clock-mirror as defined in claim 2 wherein said electrical circuit comprises means for de-energizing the electronic switch at a pre-determined interval after its energization.

* * * * *